US012661546B2

(12) United States Patent
Chu

(10) Patent No.: US 12,661,546 B2
(45) Date of Patent: Jun. 23, 2026

(54) GYM BARBELL WITH THREE-AXIS ROTATABLE HANDLES

(71) Applicant: Daniel Chu, Richmond (CA)

(72) Inventor: Daniel Chu, Richmond (CA)

( * ) Notice: Subject to any disclaimer, the term of this patent is extended or adjusted under 35 U.S.C. 154(b) by 91 days.

(21) Appl. No.: 18/748,291

(22) Filed: Jun. 20, 2024

(65) Prior Publication Data

US 2026/0115524 A1 Apr. 30, 2026

(51) Int. Cl.
*A63B 21/072* (2006.01)
*A63B 21/00* (2006.01)
*A63B 23/035* (2006.01)

(52) U.S. Cl.
CPC ..... *A63B 21/0724* (2013.01); *A63B 21/4035* (2015.10); *A63B 21/4049* (2015.10); *A63B 23/03541* (2013.01)

(58) Field of Classification Search
CPC ..... A63B 21/0004; A63B 21/072; A63B 21/0724; A63B 21/078; A63B 21/22; A63B 21/222; A63B 21/4035; A63B 21/4049; A63B 23/03541; A63B 23/1209; A63B 2244/09
See application file for complete search history.

(56) References Cited

U.S. PATENT DOCUMENTS 3,384,370 A * 5/1968 Bailey ..... A63B 21/0724 482/106
4,618,143 A * 10/1986 Twardosz ..... A63B 21/0724 482/106
4,629,184 A * 12/1986 Selkee ..... A63B 21/0724 482/106
RE33,218 E * 5/1990 Twardosz ..... A63B 21/0724 482/106
5,024,434 A * 6/1991 Smith ..... A63B 21/0728 482/106
5,080,349 A * 1/1992 Vittone ..... A63B 23/14 482/106
5,334,113 A * 8/1994 Roepke ..... A63B 21/4001 482/106
(Continued)

FOREIGN PATENT DOCUMENTS

CA 2675186 A1 * 2/2011 ..... A63B 21/154
CA 3109831 A1 * 9/2022 ..... A63B 21/4035
(Continued)

*Primary Examiner* — Gary D Urbiel Goldner

(57) ABSTRACT

A weightlifting barbell, having a barbell frame, a pair of three-axis rotatable and orbital handle mechanisms, and a pair of loadable weight sleeves. The handle mechanisms are mounted onto a horizontal section of the barbell frame, and the loadable weight sleeves are respectively mounted onto lower portions of a vertical section of the barbell frame. The handle mechanisms each contain three sets of bearing and shaft systems, allowing rotational movement in the X-axis, Y-axis, and Z-axis simultaneously, creating a free and orbital movement of handle grips of the handle mechanisms at any given time. The handle mechanisms are fixed along the barbell through a screw clamp mechanism. The handle grips are located higher in position relative to the loadable weight sleeves, to keep the barbell remaining plumb and upright during the rotational and orbital movement of the handle grips, while the barbell is free to pendulate during exercise.

4 Claims, 2 Drawing Sheets

(56) References Cited

U.S. PATENT DOCUMENTS 5,399,133 A * 3/1995 Haber ..... A63B 21/4001 482/45
5,407,405 A * 4/1995 Oren ..... A63B 21/4035 482/106
6,022,300 A * 2/2000 Hightower ..... A63B 21/0728 482/106
7,056,268 B2 * 6/2006 Emick ..... A63B 21/4035 482/106
8,360,941 B2 * 1/2013 Kristiansen ..... A63B 21/4017 482/139
8,672,815 B1 * 3/2014 Springer ..... A63B 21/0724 482/106
9,833,654 B1 * 12/2017 Gant ..... A63B 21/4035
9,855,459 B1 * 1/2018 Condara ..... A63B 21/0724
2004/0082448 A1 * 4/2004 Martin ..... A63B 21/4017 482/139
2005/0085352 A1 * 4/2005 Baxter ..... A63B 21/0724 482/100
2005/0187079 A1 * 8/2005 Diakonov ..... A63B 21/0728 482/106
2006/0040802 A1 * 2/2006 Vittone ..... A63B 23/1263 482/106
2008/0026920 A1 * 1/2008 Berenshteyn ..... A63B 21/0724 482/106
2008/0176723 A1 * 7/2008 Johnson ..... A63B 21/0724 482/106
2010/0160124 A1 * 6/2010 Berenshteyn ..... A63B 23/1281 482/106
2013/0035218 A1 * 2/2013 Wierszewski ..... A63B 21/072 482/106
2017/0157457 A1 * 6/2017 Kurabieski ..... A63B 21/4035
2018/0243605 A1 * 8/2018 Light ..... A63B 21/072
2020/0188724 A1 * 6/2020 Bauerle ..... A63B 21/4049
2020/0289870 A1 * 9/2020 Olmstead ..... A63B 23/03525
2022/0273979 A1 * 9/2022 Kinney ..... A63B 21/4035
2022/0273980 A1 * 9/2022 Kinney ..... A63B 21/4035
2023/0173332 A1 * 6/2023 Bauerle ..... A63B 21/4045 482/115

FOREIGN PATENT DOCUMENTS

CN 106861116 A * 6/2017 ..... A63B 21/0724
DE 223926 A1 * 6/1985 ..... A63B 21/0724
EP 3583984 A1 * 12/2019 ..... A63B 21/4035
KR 20100129833 A * 12/2010 ..... A63B 21/4029
KR 102448381 B1 * 9/2022 ..... A63B 21/4035

* cited by examiner

GYM BARBELL WITH THREE-AXIS ROTATABLE HANDLES

RELATED APPLICATIONS

This is a "Continuation-In-Part", for application Ser. No. 18/111,569, filed on Feb. 19, 2023.

STATEMENT REGARDING PRIOR DISCLOSURES BY THE INVENTOR OR A JOINT INVENTOR

This is a "Continuation-In-Part", for application Ser. No. 18/111,569, filed on Feb. 19, 2023.

BACKGROUND OF THE INVENTION

1. Field of the Invention

The invention pertains to the field of weightlifting equipment used for exercise and strength training, which also features adjustable or rotatable handle mechanisms, particularly used for performing bench press exercises.

2. Description of Related Art

Traditional barbells, commonly known as Olympic barbells, typically consist of a singular and straight round bar made of steel, with two loadable weight sleeves each located at opposite ends.

These traditional barbells are used for weightlifting exercises, including, but not limited to: flat bench press; incline bench press; decline bench press; overhead press; and bent-over-rows, clean and jerk, and deadlifts.

When users perform these exercises, such as bench press, they grab onto the straight barbell with both hands, constraining their hands fixed to a specific location along the barbell during the weightlifting exercise.

This fixed hand placement along the barbell creates a limitation to their mobility, resulting in shoulder joint and other bodily injuries, due to a lack of freedom of movement in the hands.

Other prior art has attempted to increase this limited range of movement and mobility, through the means of rotatable mechanisms and attachments to the barbell.

However, no prior art features a barbell with handles which can rotate in all three-axis simultaneously, enabling the handle grips to move in an orbiting motion.

It is distinctly different from other prior art, in that the rotating and orbiting motion of the handles creates a separation in movement from the remaining components of the larger assembly, which enables the user to rotate or orbit the handle grip mechanism while the rest of the other components of the larger assembly remain stationary and motionless.

The present invention incorporates in the handle mechanism a first bearing and shaft system to allow movement in the X-axis, a second bearing and shaft system to allow movement in the Y-axis, and a third bearing and shaft system to allow movement in the Z-axis. This is similar to how gyroscope or gimbal mechanisms incorporate three or more sets of bearing mechanisms to enable rotation in three axis and orbital movements, as seen in $20^{th}$-century camera equipment with gimbals or three-axis astronaut trainers. Also, the location of the handles are adjustable in width, relative to the larger barbell frame, so the user can place their hands at any desired width to perform the exercise.

The rotational and orbital feature of the handle grips is what enables users to change the position of their hands during their exercise to increase freedom of movement in a biomechanically natural manner in order to prevent shoulder and other bodily injuries.

This increased freedom of movement results in increased range of motion, increased muscle activation, and increased recruitment of stabilizer muscles to create a more efficient and effective exercise regimen for the user.

The theory for enabling rotation and orbiting of the hands during a bench press maneuver, is based on the fundamentals of martial arts, such as Karate, boxing, and self-defense. In these three disciplines or movements, when the humerus and forearm is retracted and folded close towards the body, the hands are naturally positioned supinated. When the humerus and forearm is extended and far away from the body, the hands are naturally positioned pronated. This form of movement and hand position can be demonstrated in the practice of Karate punches when martial artists punch from the waist, or in boxing when boxers hold their guard and release their punches, or when humans protect themselves by shielding themselves in the fetal position.

The supination and external rotation movement of the humerus created when retracting the hands close to the body enables a larger stretch of the pectoralis major and pectoralis minor muscles, while the pronation and internal rotation movement created when extending the hands far away forwards from the body initiates the muscle activation and increases the contraction of the muscles during the exercise. The muscles adjacent to the rotator cuff, including supraspinatus; infraspinatus; teres minor; teres major; subscapularis; triceps brachii; deltoids; trapezius; and serratus anterior; are increasingly recruited in order to stabilize the barbell and prevent any pendulating or swaying motion.

As described, having an alternating supinated and pronated biomechanical position is most natural, as demonstrated through martial arts and nature of life. Conventional barbells or other prior art are not able to offer or replicate this range of motion and poses constraints to the user due to a fixed or limited rotational positions for the hands. Other prior art may only feature a singular or dual bearing mechanism to allow handle grip rotation in a singular axis, but not orbit, while requiring the larger assembly to rotate in conjunction with the handles if any additional axis of rotation of the handle grips were desired by the user.

Thus, by creating a barbell with three-axis rotatable handles, this will solve the issues mentioned previously.

SUMMARY OF THE INVENTION

The apparatus consists of a large U-shaped frame component, with two handle mechanisms which can rotate independently in three-axis and orbit, and two loadable weight sleeves used for adding weightlifting plates onto the barbell.

The horizontal location of where the handles are fixated onto the frame can be adjusted, through a screw clamp mechanism located on the top portion of the handle assembly, so that the user can have the option of performing the exercise either holding the apparatus with a narrow grip, or a wider grip, depending on how far apart they would like their hands to be for their exercise.

As the user grips the handles, preferably when laying down to perform a typical bench press maneuver, the apparatus will hang plumb, so that the lower portions of the frame where the loadable weight sleeves are attached, will always hang lower than the user's hands, and the overall apparatus will remain upright at all times.

The vertical distance between the handles and the upper portion of the frame is about equidistant between the handles and the lower portion of the frame where the loadable sleeves are attached, meaning that the handles are located approximately halfway between the upper and lower portions of the frame, so that the center-point of the apparatus is located where the handle grips are located and that the loadable weight sleeves are not co-linear in alignment with the handle grips.

The handle mechanisms offer handle grips which can rotate and orbit in three-axis, due to the first set of bearing components and structural members along the X-axis, a second set of bearing components and structural members along the Y-axis, and a third set of bearing components and structural members in the Z-axis.

As the user grabs onto the apparatus, they are able to rotate or orbit their hands, while performing their bench press exercise, while the frame and loadable weight sleeve components remain stationary and relatively motionless depending on how steady the user performs their bench press maneuver.

The objective of the present invention is to provide a barbell which enables users to have the freedom and ability to rotate their hands in any three-axis simultaneously without affecting any movement in the overall barbell assembly.

DETAILED DESCRIPTION OF THE PREFERRED EMBODIMENTS

Figure 1:
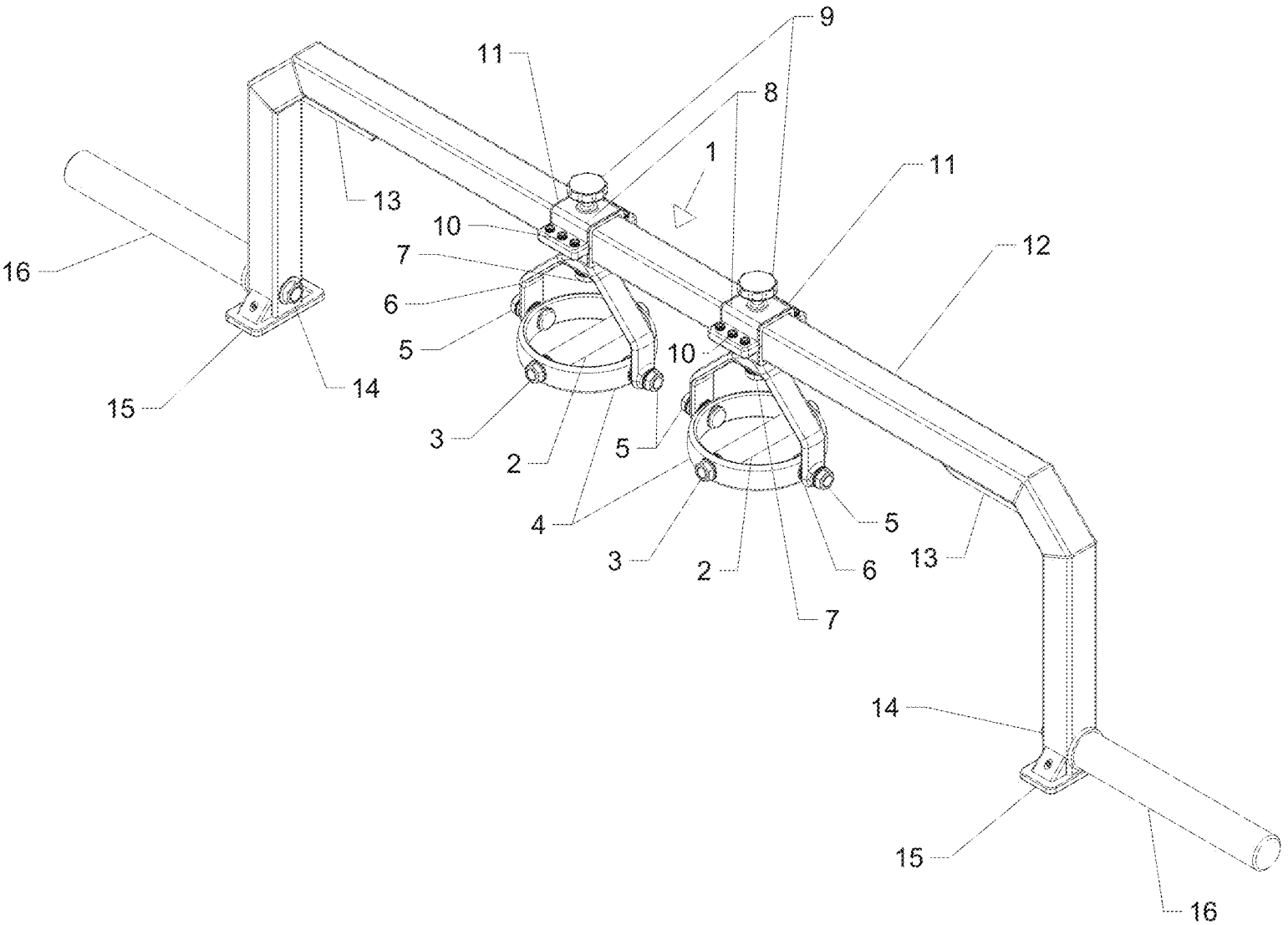
FIG. 1 is a perspective view of the present invention.
Figure 2:
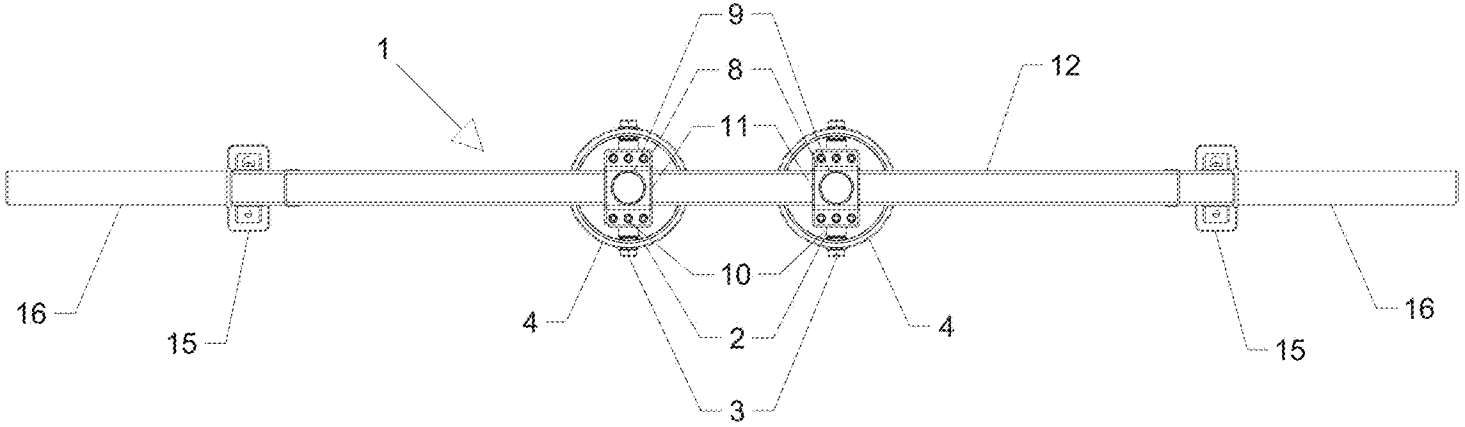
FIG. 2 is a top view of the present invention.
Figure 3:
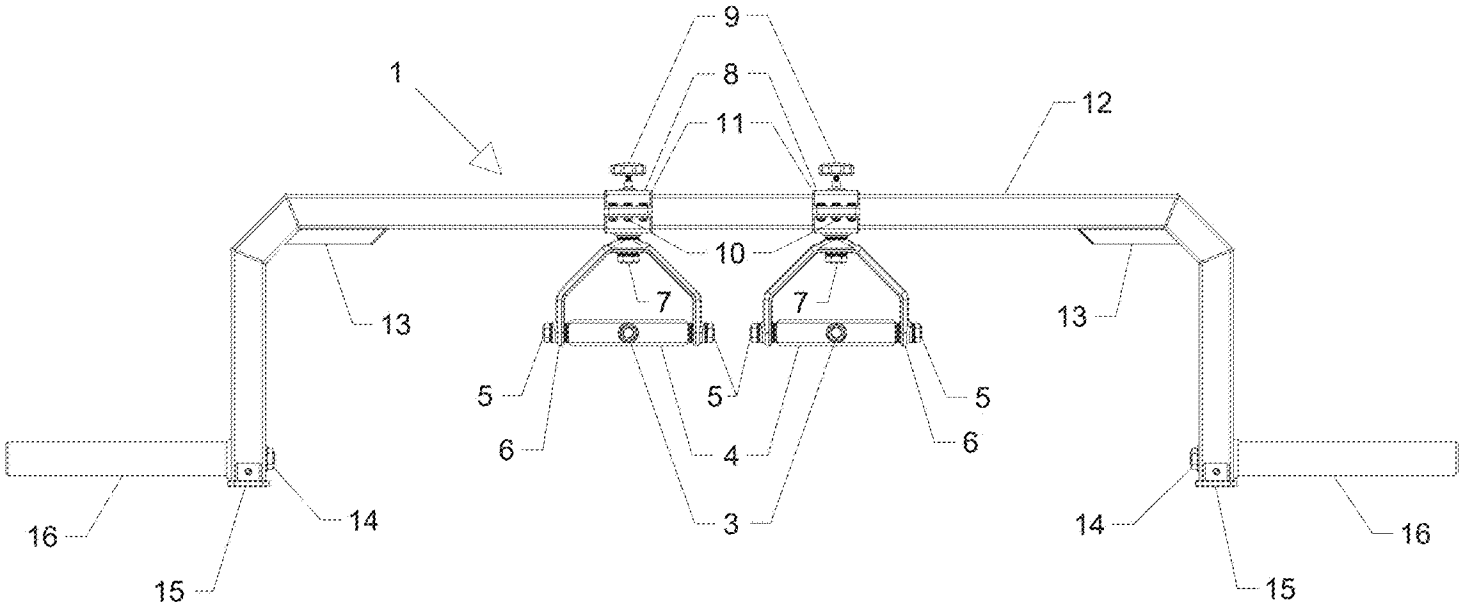
FIG. 3 is a front view of the present invention.

The present invention described herein is shown in FIG. 1, FIG. 2, and FIG. 3., is represented generally as barbell 1. The largest component in barbell 1, consists of a U-shaped frame member 12. Mounted onto the horizontal portion of 12, is a handle mechanism which consists of 2, 3, 4, 5, 6, 7, 8, 9, 10, 11. Mounted onto the lower section of the vertical portion of 12, are the loadable weight sleeves 16, attached through bolts 14.

The handle mechanism components 2, 3, 4, 5, 6, 7, 8, 9, 10, 11, are mounted onto 12 through two symmetrical and removable flanged cuffs 8 and bolts 10. It is ideal that a set of bushings 11 are present to create a smooth surface for the sliding of 8 along 12. A screw clamp mechanism 9 is located at the top, so the user can lock the cuffs 8 at a set location along 12 by turning the screw until tight, so that the handle mechanism assembly does not slide around horizontally during their exercise.

To create the three-axis rotatable and orbital handle mechanism, there are a pair of handle grips 2 with bearings inside, held in place by a shaft 3. Shaft 3 is held in place by being inserted into a circular component 4. Component 4 is attached to an A-shaped component 6 through bearings and shaft 5. Component 6 is attached to the removable flange cuffs 8, through bearings and shaft 7. At the ends of shaft 3, 5, and 7, are nuts to hold components in place.

In order for the barbell to be placed onto conventional barbell bench press racks and other cup type mounts, there is a small section of round half-pipe 13 located on the underside of the horizontal portion of the frame 12 at each ends. There is a shoe footplate 15, located at the ends of the vertical portion of the frame 12, so that the barbell does not fall over when resting on the floor and bumped slightly.

It is intended for the user of the barbell to place the handle mechanisms at their desired width location along 12, then turn the screw clamp 9 to tighten and lock the handle mechanisms in place, then place their hands around handle grips 2, and perform a typical bench press exercise. Since where the handle grips 2 are located, is much higher relative to loadable sleeve 16, the barbell will hang plumb and remain vertical and upright throughout the exercise. While exercising, the user is able to freely rotate or orbit their hands as desired in 360-degrees in all three planes of axis, X, Y, and Z. After they perform their workout, they can unscrew the screw clamp 9, slide the handles to a wider or narrower position along frame 12, and re-tighten screw clamp 9 and repeat their exercise workout. The user can also elect to place additional conventional weight plates onto sleeve 16 to increase their workout resistance.

I claim:

1. A weightlifting barbell, comprising:

a U-shaped frame, including:

an elongated horizonal portion having two opposing ends and a cross-sectional shape, the cross-sectional shape being non-circular with a plurality of edges extending along a longitudinal axis of the elongated horizontal portion; and two vertical portions respectively extending downward from the two opposing ends;

a pair of loadable barbell weight sleeves respectively coupled to lower portions of the two vertical portions and respectively extending away from the U-shaped frame, the pair of loadable barbell weight sleeves being substantially parallel to the longitudinal axis;

two shoe footplates respectively coupled to lower ends of the two vertical portions, each shoe foot plate extending laterally away from opposing sides of the corresponding vertical portion and located adjacent to the corresponding loadable barbell weight sleeve, the two shoe footplates being substantially perpendicular to both the longitudinal axis and the two vertical portions, respectively, and configured to enable the weightlifting barbell to rest on a floor without falling over; and two handles coupled along the elongated horizonal portion, the two handles being rotatable in an X-axis, a Y-axis, and a Z-axis, each handle comprising:

a first bearing and shaft system to enable rotation in the X-axis;

a second bearing and shaft system to enable rotation in the Y-axis; and a third bearing and shaft system to enable rotation in the Z-axis.

2. The weightlifting barbell of claim 1, further comprising:

a screw clamp mechanism.

3. The weightlifting barbell of claim 1, wherein the weightlifting barbell is configured to remain plumb and upright during the rotational movements of the two handles when enacted by a user.

4. The weightlifting barbell of claim 1, wherein the two handles are configured to enable the U-shaped frame and the pair of loadable barbell weight sleeves to remain relatively motionless during a pendulating movement of the weightlifting barbell while a user is capable of rotating hands of the user.

* * * * *